United States Patent [19]

Russold

[11] 4,256,001

[45] Mar. 17, 1981

[54] ANTI-SKIVING DEVICE FOR PHOTOGRAPHIC FILM

[75] Inventor: Frank J. Russold, Wichita, Kans.

[73] Assignee: Kreonite Inc, Wichita, Kans.

[21] Appl. No.: 16,445

[22] Filed: Mar. 1, 1979

[51] Int. Cl.[3] ..... B26D 3/02

[52] U.S. Cl. ..... 83/869; 84/432; 83/581

[58] Field of Search ..... 76/87, 89; 83/869, 432, 83/581; 51/102; 409/138, 226, 227, 298, 301, 303; 30/286–294, 287; 144/30, 124–126

[56] References Cited

U.S. PATENT DOCUMENTS

| | | | |
|---|---|---|---|
| 158,998 | 1/1875 | Sturtevant | 144/30 |
| 571,293 | 11/1896 | Sweet | 83/432 X |
| 715,909 | 12/1902 | Walker et al. | 83/869 X |
| 1,555,107 | 9/1925 | Dorff | 76/87 |
| 2,381,808 | 8/1945 | Davis et al. | 83/869 X |
| 2,495,814 | 1/1950 | Marcantonio | 76/87 |
| 2,617,235 | 11/1952 | Lindahl | 76/87 X |
| 2,707,852 | 5/1955 | Fillweber | 76/87 X |
| 2,865,141 | 12/1958 | Madl et al. | 51/102 X |
| 3,680,441 | 8/1972 | Parker | 83/869 X |
| 3,721,157 | 3/1973 | Bacher | 83/869 X |

FOREIGN PATENT DOCUMENTS

| | | | |
|---|---|---|---|
| 53117 | 9/1910 | Switzerland | 76/87 |
| 424107 | 2/1935 | United Kingdom | 83/581 |

*Primary Examiner*—J. M. Meister
*Attorney, Agent, or Firm*—Edwin H. Crabtree

[57] ABSTRACT

An anti-skiving device used for beveling an edge of photographic film so that when the film is processed the emulsion or anti-halation backing on the base of the photographic film will not flake or skive. The device eliminates flaked or skived material from the edge of the film from being processed on the film itself, which heretofore caused an unsightly appearance on the processed film.

4 Claims, 8 Drawing Figures

ANTI-SKIVING DEVICE FOR PHOTOGRAPHIC FILM

BACKGROUND OF THE INVENTION

This invention relates to an anti-skiving device and more particularly but not by way of limitation to a device for beveling the edge of photographic film to prevent an emulsion layer or anti-halation backing on the base of the film from flaking or skiving.

Heretofore there have been a number of patented inventions for beveling cardboard and other paper materials. These card beveling machines are disclosed in U.S. Pat. No. 362,179 to Remus, U.S. Pat. No. 323,483 to Wright, U.S. Pat. No. 887,350 to Slick, U.S. Pat. No. 765,391 to Long and U.S. Pat. No. 1,736,267 to Williams.

Also, there are various types of sharpeners for sharpening knives, cutting tools or the like. These sharpeners are disclosed in U.S. Pat. No. 1,335,603 to Roberts, U.S. Pat. No. 2,386,194 to Chester, U.S. Pat. No. 3,555,679 to Sheridan.

None of the above mentioned patents disclose or discuss the problem of skiving photographic film when it is processed and the problems caused by the skived material having an unsightly appearance when the film has been processed. Photographic film has a base with an emulsion layer thereon. Also the base may include an anti-halation backing on the back side of the base. When photographic film is cut to size the film is often cut with an unsharpened instrument, thereby causing the emulsion layer and anti-halation backing to peel at the cut edge. When the film is processed the portion of the peeled back emulsion layer or anti-halation backing skives or flakes. This material attaches itself to the surface of the film, causing small hairlike spots on the processed film, thereby causing an unsightly appearance.

SUMMARY OF THE INVENTION

The subject invention eliminates the emulsion layer or anti-halation backing on photographic film from flaking or skiving and causing an unsightly appearance when the film has been processed.

The invention is simple in design, inexpensive and can be mounted on existing photographic processing equipment. The anti-skiving device is easy to use and quickly bevels the edges of photographic film.

The anti-skiving device for photographic film includes a base, a first film guide, a second film guide, and an edge beveling means mounted on the base and disposed between the first and second film guide. The first and second film guide include elongated guide slots for receiving an edge of the film as it is guided through the edge beveling means. The edge beveling means may be a pair of parallel sharpening cylinders with rotating discs, or may be a single or a pair of cutting blades.

The advantages and objects of the invention will become evident from the following detailed description when read in conjunction with the accompanying drawings which illustrate the preferred embodiments of the invention.

DETAILED DESCRIPTION OF THE DRAWINGS

Figure 1:
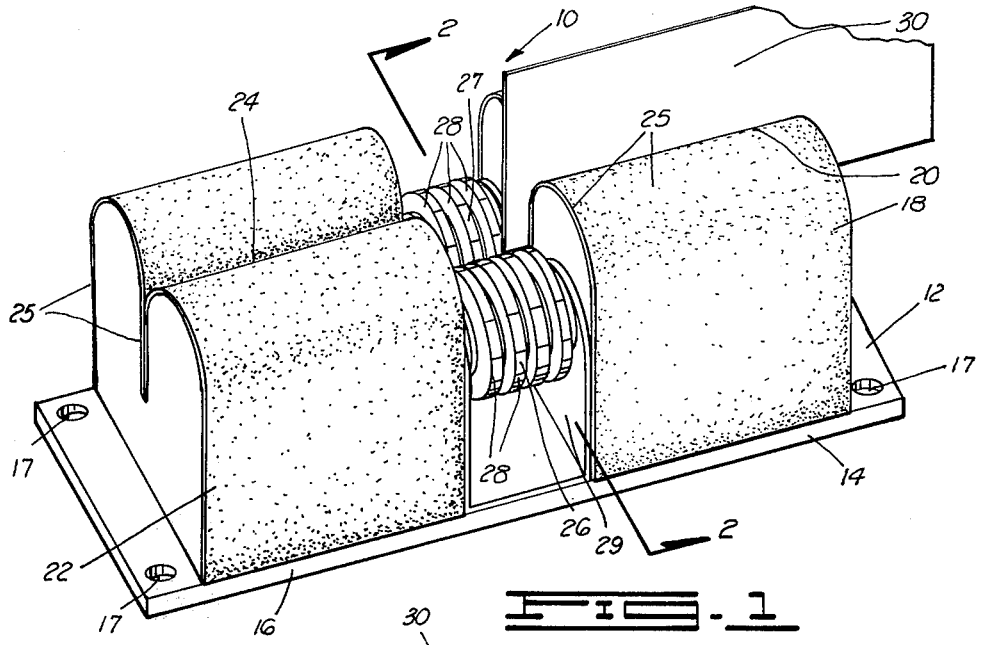
FIG. 1 is a perspective view of the anti-skiving device.

In FIG. 1 a perspective view of the anti-skiving device for photographic film is illustrated and designated by general reference numeral 10. The device 10 includes a base 12 having a first end 14, and a second end 16. The first end 14 and second end 16 of the base 12 include apertures 17 for receiving screws or the like for securing the device 10 on existing or new photographic processing equipment. Mounted on the first end 14 of the base 12 is a first film guide 18 having an elongated guide slot 20 therein. Mounted on the second end 16 of the base 12 is a second film guide 22 identical to the first film guide 18 and including an elongated guide slot 24 therein. The first film guide 18 and second film guide 22 are covered with a soft cloth-like material 25 to prevent the scratching of the film when received on the device 10.

Mounted on top of the base 12 and disposed between the first film guide 18 and second film guide 22 are a pair of parallel sharpening cylinders 26 and 27 having rotatable, spaced apart discs 28. The discs 28 of one of the cylinders 26 overlaps and are adjacent the discs 26 of the other cylinder 27. The two cylinders 26 and 27 are supported at both ends by a cylinder support 29.

In FIG. 1 a portion of a photographic film 30 can be seen received in the elongated guide slot 20 of the first guide 18. Also seen is a portion of the film 30 being received between rotatable spaced apart discs 28.

Figure 2:
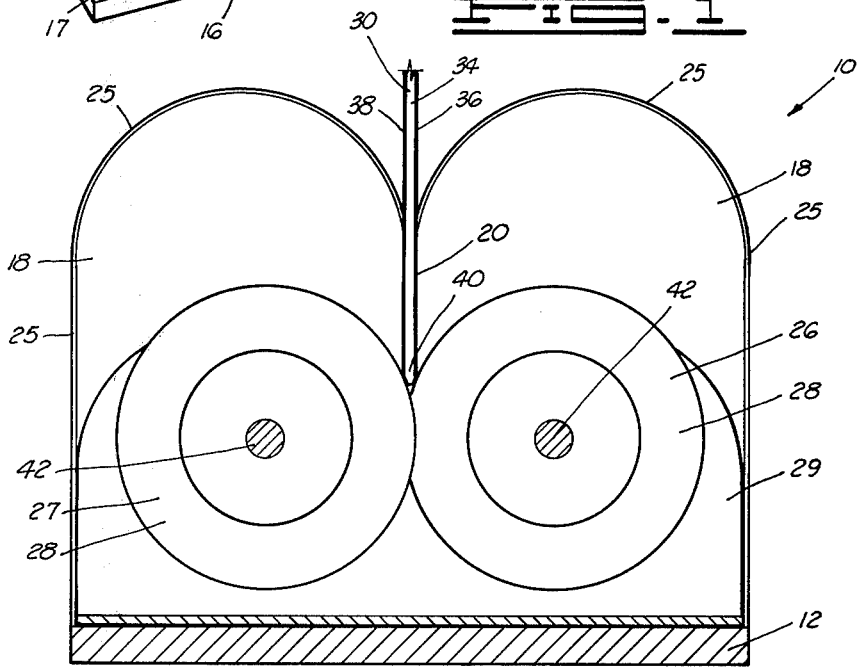
FIG. 2 is a sectional view of the anti-skiving device taken along line 2—2 shown in FIG. 1.

In FIG. 2, a side sectional view of the device 10 is shown taken along lines 2—2 shown in FIG. 1. In this view the film 30 can be seen having a base 34 with an emulsion layer 36 on the front side of the film 30 and an anti-halation backing 38 on the backside of the film 30. The depth of the elongated guide slot 20 of the first film guide 18 and also the depth of the elongated guide slot 24 of the second film guide 22 correspond with the correct depth between the discs 28 for guiding an edge 40 of the film 30 through the rotatable spaced apart discs 28 so that the emulsion layer 36 and anti-halation backing 38 are bevelled to prevent flaking or skiving when the film 30 is processed. Seen in this view are shafts 42 which are attached at both ends to the cylinder support 29.

Figure 3:
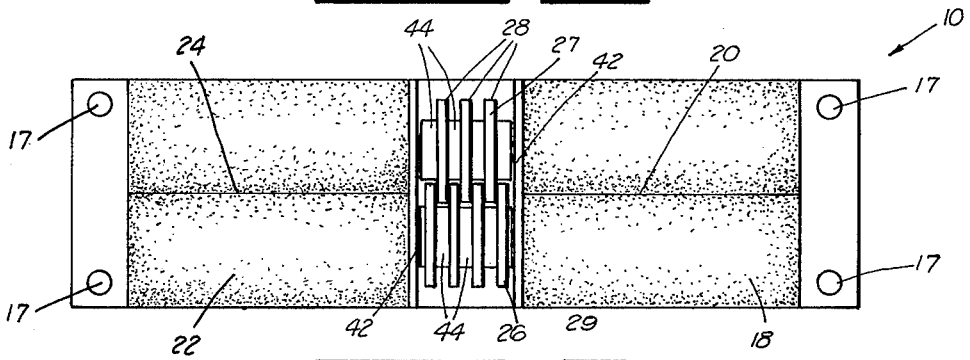
FIG. 3 is a top view of the anti-skiving device.

In FIG. 3 a top view of the device 10 can be seen with the film 30 removed. In this view the parallel sharpened cylinders 26 and 27 can be seen more clearly with the overlapping rotatable discs 28 mounted on the shafts 42 and including washers 44 disposed on the shafts 42 and separating the discs 28.

Figure 4:
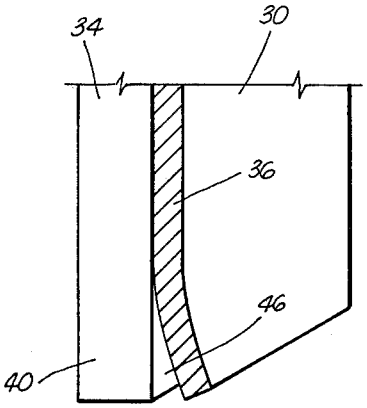
FIG. 4 is a greatly enlarged perspective view of an edge of photographic film with the emulsion layer separated from the film base.
Figure 5:
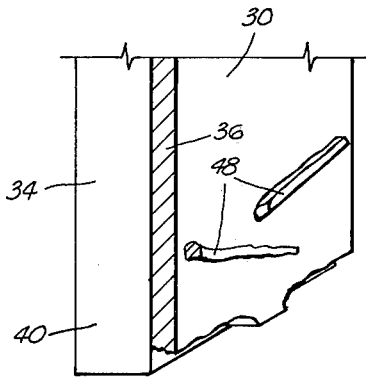
FIG. 5 illustrates the skiving or flaking of the emulsion on top of the film.

In FIG. 4 a greatly enlarged perspective view of the edge 40 of photographic film 30 is shown having the base 34 and emulsion layer 36 on the front of the base 34. This drawing is shown to illustrate what happens when the edge 40 of the film 30 is cut with an unsharpened cutting edge causing a separation in an area 46 between the base 34 and the emulsion layer 36. When this happens, the emulsion layer 36 where it has separated will flake and skive as shown in FIG. 5 wtih the separated portion of the emulsion layer 36 causing unsightly hairlike spots 48 and an unprofessional appearance in the processed film.

Figure 6:
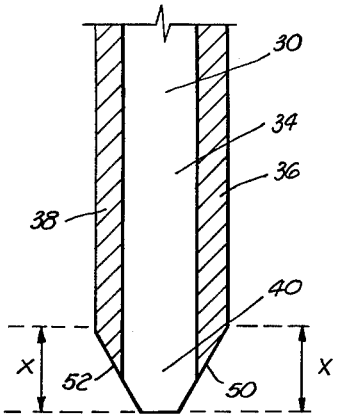
FIG. 6 is a side view of a beveled edge of photographic film.

In FIG. 6 the greatly enlarged side view of the edge 40 of the film 30 is shown having bevelled areas 50 and 52. The bevelled area 50 includes a portion of the end of the emulsion layer 36 and a portion of the base 34. The bevelled area 52 includes a portion of the end of the anti-halation backing 38 and a portion of the base 34. The bevelled areas 50 and 52 are the result of the edge 40 of the film 30 being guided through the anti-skiving device 10 so that there are no portions of the emulsion layer 36 and anti-halation backing 38 which will skive or flake during the processing of the film 30. It should be noted that height X represents the correct amount of the edge 40 which is guided through the device 10. If not enough of the emulsion layer 36 and anti-halation backing 38 is removed then skiving will occur. In turn if too much of the emulsion layer 36 and anti-halation backing 38 is removed, the edge 40 of the film 30 will buckle or break causing the film to be unacceptable. The correct height X is accomplished by proper depth of the guide slots 20 and 24 in relationship to the cylinders 26 and 27.

Figure 7:
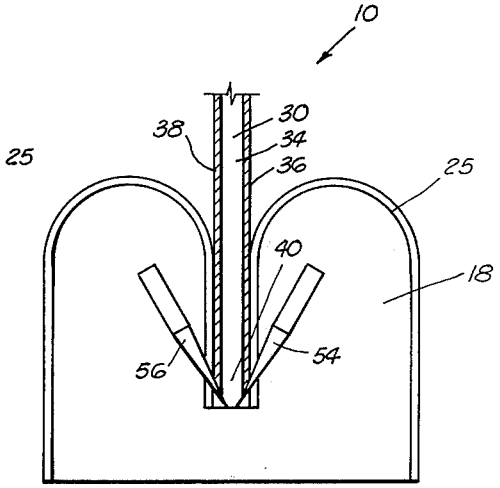
FIG. 7 illustrates an alternate embodiment of the anti-skiving device having a pair of cutting blades.

FIG. 7 illustrates an alternate embodiment of the device 10 wherein a pair of cutting blades 54 and 56 are substituted for the parallel sharpening cylinders 26 and 27. The blades 54 and 56 are disposed opposite each other and adjacent the first film guide 18 and at an angle to bevel the edge 40 of the film 30 at a proper angle similar to the bevel of the areas 50 and 52 shown in FIG. 6.

Figure 8:
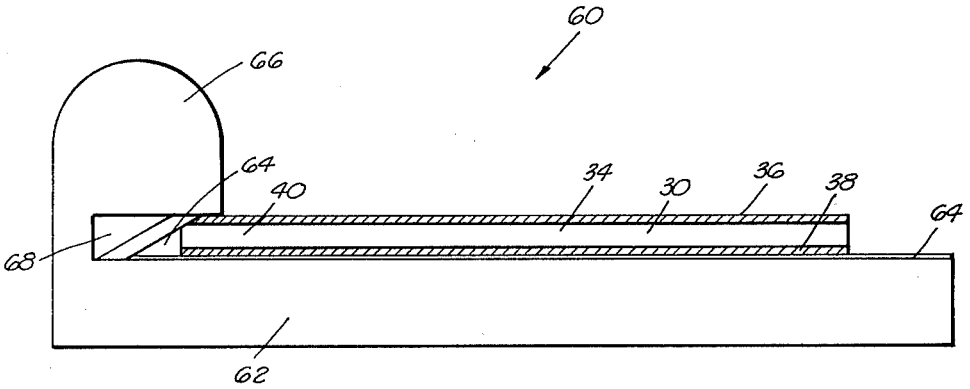
FIG. 8 is an alternate embodiment of the anti-skiving device having a single cutting blade.

FIG. 8 illustrates an alternate embodiment of an anti-skiving device 60. The device 60 includes a horizontal base 62 with a soft cloth-like material 64 mounted on top thereof to prevent the scratching of the film 30. A film guide 66 is mounted on one end of the base 62 and includes an elongated guide slot 64 therein. Mounted adjacent the guide slot 64 is a single cutting blade 68 disposed at an angle so that a proper bevel is cut in the edge 40 of the film 30. In this figure the emulsion layer 36 is shown being bevelled along with a portion of the base 34. When the emulsion layer 36 has been bevelled the film 30 is turned over and the film 30 is again guided through the guide slot 34 and past the cutting blade 68 for bevelling a portion of the anti-halation backing 38 and base 40.

While the device 60 is similar to the anti-skiving device 10 it is shown to illustrate that various embodiments of the anti-skiving device may be shown without departing from the overall scope of the invention. The basic purpose again of the invention is to bevel the edge 40 of the film 30 to prevent the emulsion layer 36 and the anti-halation backing 38 from skiving during the processing of the film 30.

Changes may be made in the construction and arrangement of the parts or elements of the embodiments as disclosed herein without departing from the spirit or scope of the invention defined in the following claims:

I claim:

1. An anti-skiving device for photographic film, the device beveling the sides of an edge of photographic film so that a layer of emulsion and anti-halation backing on the film will not flake or skive when the film is processed, the device comprising:

a base;

a first film guide mounted on the base and having an elongated guide slot with a pre-determined depth therein for receiving an edge of the film to be beveled; and a pair of parallel sharpening cylinders having rotatable spaced-apart discs, the discs of one cylinder overlapping and adjacent the discs of the other cylinder, the depth between the discs corresponding with the depth of the elongated slot of the first film guide.

2. The device as described in claim 1 further including a second film guide and having an elongated slot with a pre-determined depth therein, the second film guide mounted on the base and disposed on the opposite end of the sharpening cylinders for receiving the beveled edge of the film as it is guided through the sharpening cylinders, the depth of the guide slot of the second film guide corresponding to the depth of the guide slot of the first film guide and the depth between the discs of the sharpening cylinders.

3. The device as described in claim 2, wherein the first and second film guides are covered with a soft cloth-like material to prevent the scratching of the film when it is placed thereon.

4. An anti-skiving device for photographic film, the device beveling the sides of an edge of the photographic film so that a layer of emulsion and anti-halation backing on the film will not flake or skive when the film is processed, the device comprising:

a base;

a first film guide mounted on the base and having an elongated guide slot with a pre-determined depth therein for receiving an edge of the film to be beveled;

a pair of parallel sharpening cylinders having rotatable spaced-apart discs, the discs of one cylinder overlapping and adjacent the discs of the other cylinder, the depth between the discs corresponding with the depth of the elongated slot of the first film guide; and a second film guide having an elongated slot with a pre-determined depth therein, the second film guide mounted on the base and disposed on the opposite end of the sharpening cylinders for receiving the beveled edge of the film as it is guided through the sharpening cylinders, the depth of the guide slot of the second film guide corresponding to the depth of the guide slot of the first film guide and the depth between the discs of the sharpening cylinders.

* * * * *